United States Patent [19]

Dixon et al.

[11] 4,272,364

[45] Jun. 9, 1981

[54] FROTHER FOR COAL FLOTATION

[75] Inventors: Kenneth W. Dixon, Drexel Hill; Frederick A. Hoffstadt, Coraopolis, both of Pa.

[73] Assignee: Calgon Corporation, Pittsburgh, Pa.

[21] Appl. No.: 133,050

[22] Filed: Mar. 24, 1980

[51] Int. Cl.[3] ..... B03D 1/02

[52] U.S. Cl. ..... 209/166; 568/740

[58] Field of Search ..... 209/166, 167; 252/61; 568/740

[56] References Cited

U.S. PATENT DOCUMENTS

| | | | |
|---|---|---|---|
| 1,773,997 | 8/1930 | Green | 209/167 |
| 2,065,053 | 12/1936 | Christmann | 209/166 |
| 2,765,077 | 10/1956 | Ferris | 209/166 |
| 3,459,649 | 8/1969 | Muller | 209/166 |
| 4,196,092 | 4/1980 | Wang | 209/166 X |

FOREIGN PATENT DOCUMENTS

| | | | |
|---|---|---|---|
| 1064442 | 9/1959 | Fed. Rep. of Germany | 209/166 |
| 1165512 | 3/1964 | Fed. Rep. of Germany | 209/166 |
| 49-48603 | 12/1974 | Japan | 209/166 |

OTHER PUBLICATIONS

Chem. Abst. 68, 1968, 4716g.

*Primary Examiner*—Robert Halper

*Attorney, Agent, or Firm*—Mario A. Monaco; Martin L. Katz

[57] ABSTRACT

Use of 4,4-dimethyl-1-pentanol as a froth flotation agent for coal recovery processes.

2 Claims, No Drawings

FROTHER FOR COAL FLOTATION

This invention relates to frothers for use in coal flotation processes.

More particularly, this invention relates to the use of 4,4-dimethyl-1-pentanol as a frother for use in coal flotation processes.

Coal flotation processes are used to separate finely ground coal particles from their associated waste or gangue by means of the affinity of surfaces of these coal particles for air bubbles, thus concentrating the coal particles. In flotation processes, a coating can be placed on the coal particles so that the particles may attach to the air bubble and be floated, since the air bubble will often not adhere as well to a clean mineral surface such as coal.

In the froth flotation of coal, a froth is formed by introducing air into a slurry which contains the impure finely divided coal particles and water. The flotation separation of coal from the residue or gangue depends upon the relative wettability of surfaces and the contact angle, which is the angle created by the solid/air bubble interface.

Three general classes of reagents have been utilized in flotation processes. These are (1) collectors or promoters; (2) modifiers; and (3) frothers. Promoters are usually kerosene and fuel oil, while modifiers may be pH regulators, activators, depressants, dispersants or flocculants. Frothers are utilized to provide a stable flotation froth that is durable enough to facilitate the coal separation, but not so durable that it cannot be broken to allow subsequent handling. Examples of commonly used frothing agents are pine oil, creosote, cresylic acid and alcohols such as methyl isobutylcarbinol (MIBC) which is also known as 4-methyl-2-pentanol.

We have, however, discovered a frother which provides improved rates of coal recovery when compared to the most widely used frother, methyl isobutylcarbinol. Our improved frother is 4,4-dimethyl-1-pentanol which may be added to the flotation circuit in the conventional manner at a concentration of from 0.01 to 1.0 pounds per ton of dry coal or, more preferably, from 0.05 to 0.5 pounds per ton of dry coal. The frother is normally added to the slurry to be floated and the slurry conditioned about 15 to 30 seconds before beginning the flotation.

The invention will become more readily apparent upon reference to the following representative examples.

EXAMPLE 1

Preparation of 4,4-Dimethyl-1-Pentanol

A. 4,4-Dimethyl-1-Bromopentane

To a round bottom flask was added 10.4 g of 4,4-dimethylpentene-1 (Fluka AG). The material was cooled to 0° to 5° C. and dry hydrogen bromide was bubbled in for one hour. After standing overnight at 0° C., the excess hydrogen bromide was removed under vacuum. The lack of vinyl protons in the NMR (δ 5.45 to 6.1, m) indicates that reaction has occurred. NMR ($CDCl_3$) δ 3.3 (t, $—CH_2—Br$), δ 2.05 to 1.1 (m, $—CH_2—CH_2—$), δ 0.85 (s, $CH_3—$).

B. 4,4-Dimethyl-1-Pentyl Acetate

A 10 percent aqueous solution of tetraethylammonium hydroxide was neutralized with acetic acid. The solvent was removed under vacuum and the white residue dissolved in 25 ml of DMF. To the molar excess of tetraethylammonium acetate was added the 4,4-dimethyl-1-bromopentane with 5 ml of DMF. After stirring for 40 hours at ambient temperature, the yellow solution was extracted three times with 50 ml portions of hexane. The combined hexane extracts were stripped under vacuum. The clear, oily residue showed the expected NMR with no evidence for the triplet at δ 3.3. NMR ($CDCl_3$) δ 3.95 (t, $—CH_2—O—$), δ 2.0 (s, $CH_3CO_2—$), δ 1.75 to 1.0 (m, $—CH_2—CH_2—$), δ 0.85 (s, $—CH_3$).

C. 4,4-Dimethyl-1-Pentanol

The acetate from the previous reaction was dissolved in 25 ml of methanol and 21 g of a 15 percent solution of sodium hydroxide was added. The solution was heated to reflux for 2.5 hours. The methanol layer was extracted three times with 40 ml portions of hexane. The hexane was removed under vacuum. The oily residue was distilled to give 0.94 g (7.6 percent overall yield) bp 141° C. (Lit. 158° C.). The NMR spectrum showed no acetyl protons. NMR ($CDCl_3$) δ 3.58 (t, $—CH_2—O—$), δ 2.05 (s, —OH), δ 1.85 to 1.0 (m, $—CH_2—CH_2—$), δ 0.9 (s, $—CH_3$). The singlet at δ 2.05 shifted downfield as expected on the addition of a small amount of acid.

EXAMPLE 2

The advantages of 4,4-dimethyl-1-pentanol over 4-methyl-2-pentanol (MIBC) are demonstrated by a test in which a slurry of coal fines (4 to 8 weight percent) at a pH of 7.4 to 8.5 is kept agitated. Three and three tenths liters of the slurry are placed in a laboratory flotation cell and the impeller speed is set at 1250 pm. The following sequence is followed:

| Time (min.) | Step |
|---|---|
| — | Add kerosene (0.5 to 3 lb./ton) |
| 1.0 | Add frother (0.1 to 0.3 lb./ton) |
| 1.5 | Begin air injection (flotation) |
| 4.5 | End flotation |

The air is injected at a rate of 5 liters/minute and the froth (concentrate) is removed, dried, weighed and evaluated for ash content. Similarly, the material left in the cell (tailings) is dried, weighed and evaluated for ash content.

The results of these tests are set forth in the following table.

TABLE I

| Reagent Dosages | | Concentrate Recovery and Grade | | | | | |
|---|---|---|---|---|---|---|---|
| Frother (lb/t) | Kerosene (lb/t) | Cumulative Float Time (minutes): | 0.5 | 1.0 | 2.0 | 5.0 | Tailings |
| MIBC/0.1 | 1.0 | Recovery | 26.16 | 45.01 | 59.34 | 74.41 | — |
| | | Grade | 88.50 | 88.89 | 88.65 | 86.95 | 25.35 |
| DMP/0.1 | 1.0 | Recovery | 47.95 | 63.75 | 75.36 | 86.80 | — |
| | | Grade | 88.56 | 88.42 | 87.65 | 85.37 | 15.91 |
| MIBC/0.1 | 1.0 | Recovery | 30.15 | 47.79 | 61.72 | 77.14 | — |
| | | Grade | 88.34 | 88.71 | 85.21 | 86.03 | 24.21 |
| DMP/0.1 | 1.0 | Recovery | 39.47 | 59.15 | 72.74 | 85.18 | — |
| | | Grade | 88.66 | 88.56 | 87.73 | 85.07 | 17.97 |
| MIBC/0.1 | 1.0 | Recovery | 31.12 | 47.46 | 61.17 | 77.66 | — |
| | | Grade | 89.32 | 89.30 | 88.67 | 85.09 | 23.83 |
| DMP/0.1 | 1.0 | Recovery | 43.50 | 59.35 | 71.75 | 85.08 | — |
| | | Grade | 89.28 | 89.03 | 88.31 | 85.68 | 17.56 |

MIBC = 4-methyl-2-pentanol.
DMP = 4,4-dimethyl-1-pentanol.

We claim:

1. A method of improving the recovery of coal undergoing a concentration treatment of froth flotation which comprises adding at least 0.01 pounds of 4,4-dimethyl-1-pentanol per ton of dry coal and recovering a concentrate of said coal in said frother.

2. A method as in claim 1 wherein from 0.05 to 0.5 pounds of 4,4-dimethyl-1-pentanol per ton of dry coal are added to the coal slurry.

* * * * *